US007757784B2

(12) United States Patent
Fincher et al.

(10) Patent No.: US 7,757,784 B2
(45) Date of Patent: Jul. 20, 2010

(54) DRILLING METHODS UTILIZING INDEPENDENTLY DEPLOYABLE MULTIPLE TUBULAR STRINGS

(75) Inventors: Roger Fincher, Conroe, TX (US); Allen Sinor, Conroe, TX (US); Larry Watkins, Houston, TX (US); Joel Wilmes, Spring, TX (US)

(73) Assignee: Baker Hughes Incorporated, Houston, TX (US)

( * ) Notice: Subject to any disclaimer, the term of this patent is extended or adjusted under 35 U.S.C. 154(b) by 708 days.

(21) Appl. No.: 11/166,471

(22) Filed: Jun. 24, 2005

(65) Prior Publication Data

US 2005/0274547 A1 Dec. 15, 2005

Related U.S. Application Data

(63) Continuation-in-part of application No. 11/068,941, filed on Feb. 28, 2005, now Pat. No. 7,316,274, and a continuation-in-part of application No. 10/783,720, filed on Feb. 19, 2004, now Pat. No. 7,395,882, application No. 11/166,471, which is a continuation-in-part of application No. 10/783,471, filed on Feb. 20, 2004, now Pat. No. 7,114,581, which is a continuation-in-part of application No. 10/716,106, filed on Nov. 17, 2003, now Pat. No. 6,854,532.

(60) Provisional application No. 60/649,496, filed on Feb. 3, 2005, provisional application No. 60/583,121, filed on Jun. 24, 2004, provisional application No. 60/579,818, filed on Jun. 14, 2004.

(51) Int. Cl.
*E21B 7/00* (2006.01)

(52) U.S. Cl. ..... 175/57; 175/171; 175/263; 175/402; 166/242.7; 166/242.8

(58) Field of Classification Search ..... 175/57, 175/171, 263, 402; 166/242.7, 242.8
See application file for complete search history.

(56) References Cited

U.S. PATENT DOCUMENTS

| | | | |
|---|---|---|---|
| 1,342,424 | A | 6/1920 | Cotton |
| 1,981,525 | A | 11/1934 | Price |
| 1,997,312 | A | 4/1935 | Satre |
| 3,624,760 | A | 11/1971 | Bodine |

(Continued)

FOREIGN PATENT DOCUMENTS

| | | |
|---|---|---|
| DE | 4432710 | 11/1996 |

(Continued)

*Primary Examiner*—David J Bagnell
*Assistant Examiner*—Robert E Fuller
(74) *Attorney, Agent, or Firm*—Cantor Colburn LLP

(57) ABSTRACT

A novel well bore drilling system and method utilizes independently deployable multiple tubular strings to drill, line and cement multiple hole sections without intervening trips to the surface. In one embodiment, the drilling system includes two or more independent, telescoping, tubular members that form a nested tubular assembly and one or more sensors disposed on the nested tubular assembly. The nested tubular string is deployed in the wellbore in conjunction with a Bottom Hole Assembly (BHA). In some embodiments, a drilling motor for rotating a drill bit is also positioned in the tubular assembly. The sensors can be disposed in a stator of the drilling motor or adjacent the motor. Also, in embodiments, the sensors can be positioned on extensible members that can position the sensor or sensors adjacent the wellbore wall.

12 Claims, 11 Drawing Sheets

U.S. PATENT DOCUMENTS

| | | | | |
|---|---|---|---|---|
| 4,190,383 | A | 2/1980 | Pryke | |
| 4,759,413 | A | 7/1988 | Bailey et al. | |
| 4,842,081 | A | 6/1989 | Parant | |
| 5,168,941 | A | 12/1992 | Fincher | |
| 5,285,204 | A * | 2/1994 | Sas-Jaworsky | 340/854.9 |
| 5,311,954 | A | 5/1994 | Quintana | |
| 5,957,225 | A | 9/1999 | Sinor | |
| 6,415,877 | B1 | 7/2002 | Fincher | |
| 6,513,606 | B1 | 2/2003 | Krueger | |
| 6,622,803 | B2 * | 9/2003 | Harvey et al. | 175/325.3 |
| 6,648,081 | B2 | 11/2003 | Fincher | |
| 6,702,040 | B1 | 3/2004 | Sensenig | |
| 6,747,570 | B2 * | 6/2004 | Beique et al. | 340/856.3 |
| 6,943,697 | B2 * | 9/2005 | Ciglenec et al. | 340/853.1 |
| 7,219,752 | B2 | 5/2007 | Wassell et al. | |
| 2004/0026126 | A1 | 2/2004 | Angman | |
| 2004/0124010 | A1 | 7/2004 | Galloway et al. | |
| 2005/0072565 | A1 * | 4/2005 | Segura et al. | 166/100 |
| 2005/0103525 | A1 * | 5/2005 | Sangesland | 175/7 |
| 2007/0284148 | A1 | 12/2007 | Wassell et al. | |

FOREIGN PATENT DOCUMENTS

| | | |
|---|---|---|
| EP | 1006260 | 7/2000 |
| WO | WO 02/46564 | 6/2002 |
| WO | WO 03/087525 | 10/2003 |
| WO | WO 2004/001180 | 12/2003 |
| WO | WO 2004/097168 | 11/2004 |

* cited by examiner

FIG. 3A

FIG. 3B

FIG. 3

DRILLING METHODS UTILIZING INDEPENDENTLY DEPLOYABLE MULTIPLE TUBULAR STRINGS

CROSS-REFERENCE TO RELATED APPLICATIONS

This application takes priority from U.S. Provisional Application Ser. No. 60/649,496, filed on Feb. 3, 2005 titled "DRILLING SYSTEMS AND METHODS UTILIZING SENSORS POSITIONED ON INDEPENDENTLY DEPLOYABLE MULTIPLE TUBULAR STRINGS" and from U.S. Provisional Application Ser. No. 60/583,121 filed Jun. 24, 2004, titled "DRILLING SYSTEMS AND METHODS UTILIZING INDEPENDENTLY DEPLOYABLE MULTIPLE TUBULAR STRINGS". This application is a continuation-in-part of U.S. application Ser. No. 10/783,720 filed on Feb. 19, 2004 now U.S. Pat. No. 7,395,882 titled "Casing And Liner Drilling Bits, Cutting Elements Therefor, And Methods Of Use." This application is also a continuation-in-part from U.S. patent application Ser. No. 11/068,941 filed on Feb. 28, 2005 now U.S. Pat. No. 7,316,274 titled "One Trip Perforating, Cementing, and Sand Management Apparatus and Method," and U.S. application Ser. No. PCT/US05/20938 filed Jun. 14, 2005 which takes priority from 60/579,818, filed on Jun. 14, 2004 titled "One Trip Well Apparatus with Sand Control." This application is also a continuation-in-part of U.S. Applications titled "Active Controlled Bottomhole Pressure System & Method" Ser. No. 10/783,471 filed on Feb. 20, 2004 now U.S. Pat. No. 7,114,581 and U.S. Application titled "Subsea Wellbore Drilling System for Reducing Bottom Hole Pressure" Ser. No. 10/716,106, filed on Nov. 17, 2003 now U.S. Pat. No. 6,854,532.

BACKGROUND OF THE INVENTION

1. Field of the Invention

The present invention relates generally to drilling a subterranean wellbore and, more specifically, to sensors used in connection with nested tubular assemblies that can drill and line a section of a wellbore without having an intervening trip of a drill string and BHA to the surface.

2. State of the Prior Art

Hydrocarbons such as oil or gas from an oilfield are produced from wellbores intersecting one or more hydrocarbon producing reservoirs in the oilfield. The time and capital investment associated with drilling such wellbores have always been substantial. Factors influencing the overall cost of a well include the time required to drill a wellbore, the geographical accessibility of the oil field, and the complexity and/or depth of the wellbore. In the discussion below, it will become apparent that under many circumstances, the predicted costs for drilling a particular wellbore cannot be sufficiently offset by the expected production of hydrocarbons from the reservoir the wellbore drains, thereby making such oilfields uneconomical to develop.

As is well known, oilfield wellbores are drilled by rotating a drill bit conveyed into the wellbore by a drill string. The drill string includes a drill pipe (tubing) that has at its bottom end a drilling assembly (also referred to as the "bottomhole assembly" or "BHA") that carries the drill bit for drilling the wellbore. After a selected portion of the wellbore has been drilled, this "open hole" section is usually lined or cased with a string or section of casing. In some cases, it may be possible to drill a wellbore to the target depth and thereafter case the wellbore. More frequently, the planned trajectory of a wellbore and formation properties will require sections of the wellbore to be cased before successive sections of the wellbore can be drilled. For instance, the wellbore may intersect a number of zones, each of which may have different fluids (e.g., water, gas, oil). Thus, casing may be needed to provide zonal isolation; e.g., prevent a water zone from invading an oil zone. Moreover, the drilling activity may require the use of drilling fluid having pressures that exceed the fracture pressure of the "open hole" sections. Thus, the casing may be needed to prevent damage to the exposed formation. Also, the casing may be needed to maintain wellbore stability; e.g., to prevent the wellbore from collapsing. Therefore, drilling and casing according to the conventional process typically requires drilling a section of the wellbore, tripping the drill string and drill bit out of the wellbore, conveying a casing into the wellbore, cementing the casing in place, tripping the drilling string back into the hole, drilling the next section of the wellbore, and so on.

Unfortunately, conventional drilling and casing methods can be time consuming because wellbores routinely reach depths of thousands of feet. Thus, the time required to simply trip the drill string into and out of the wellbore can require dozens of hours. During tripping, no other meaningful activity usually occurs (e.g., drilling or casing the wellbore). This idle time can be particularly disadvantageous given that rig costs can approach and exceed one hundred thousand dollars per day. Multiple trips also are disadvantageous because they can delay the beginning of profitable production. Moreover, control of the well may be difficult during the period of time that the drill pipe is being removed and the casing is being disposed into the wellbore. Also, as is known, each trip into and out of the wellbore carries the risk that the drill string may become stuck in the wellbore or suffer some other time of failure that requires an expensive remedial operation (e.g., fishing, sidetrack, etc.).

The present invention addresses these and other drawbacks of the prior art.

SUMMARY OF THE INVENTION

The present invention provides, in one aspect, systems, devices and methods that enable a drill string and attached bottomhole assembly (BHA) to drill and line successive wellbore sections without need for intervening trips out of the wellbore. In one embodiment, a nested tubular assembly formed of two or more tubular strings are conveyed into a wellbore by a drill string provided with a BHA. Devices used in conjunction with the nested tubular assembly can include a hole enlargement device for enlarging the diameter of the wellbore, a BHA retraction device for selectively retracting the BHA into the nested tubular assembly, a drill string extension connecting the nested tubular assembly to the BHA, a nested liner shoe bit for reaming and/or drilling the wellbore, and a nested liner hanger tool for selectively interlocking the tubular strings. Devices such as upper and lower fluid flow diverters and a cross-over can be used to actuate the above described components and to control the flow paths of cement and drilling fluid. The tubular strings of the tubular assembly can be any structure that can be connected to the wellbore, either permanently or temporarily, to provide isolation, strength, stability, and/or protection for a section of a wellbore. These tubular strings can be arranged telescopically, in a "nested" fashion, or in an axially-stacked fashion.

In an exemplary mode of operation, a nested tubular assembly made up of at least an inner and outer tubular string is temporarily suspended or anchored just above well total depth to prepare for the drilling operation. As the next section of well is drilled, the nested tubular assembly is carried into the drilled section during the drilling operation by its coupling to the drilling BHA. Once a selected depth is reached, the outer tubular string is connected to the wellbore. As the next wellbore section is drilled, the remaining inner tubular string is carried along with the BHA as this section is drilled and connected to the wellbore after another selected depth has been reached. These steps, or variations of these steps, are continued until the tubular strings making up the nested tubular assembly have been connected, temporarily or permanently, to the drilled wellbore sections. Thereafter, the BHA can be tripped out of the wellbore or left in place. In either case, it will be appreciated that the reduction of BHA and drill string trips into and out of the wellbore will provide a corresponding reduction in the time needed to drill and complete a wellbore.

In embodiments, the present invention provides a system for drilling a wellbore that includes one or more sensors used in conjunction with a tubular assembly adapted to be connected to the wellbore. The tubular assembly includes at least two tubular strings deployed in a manner previously described. Advantageously, formation evaluation tools and other sensors are positioned at least partially on the tubular string rather than positioned in the BHA. Thus, the length of the BHA extending below the tubular assembly is correspondingly reduced. By positioning formation evaluation tools such as tools for measuring gamma ray, resistivity, etc. on the outside of the tubular assembly, the metal making up the tubular assembly will not interfere with the operation of such tools. Further, sensors for measuring parameters of interest relating to wellbore fluids or drilling fluids can also be disposed in the tubular assembly.

In some embodiments, the tubular assembly includes a drilling motor for rotating a drill bit provided in the BHA. In such embodiments, the sensors can be positioned on the drilling motor or in a section adjacent the drilling motor. Additionally, in embodiments, the sensors can be separated from the wellbore wall during operation. This may occur, for example, where the sensor or sensors are positioned uphole of a hole enlargement device. This separation may impair the operation of some formation evaluation tools. Therefore, in such situations, the sensor or sensors can be positioned on extensible members that move the sensors radially toward the wellbore wall.

Examples of the more important features of the invention have been summarized (albeit rather broadly) in order that the detailed description thereof that follows may be better understood and in order that the contributions they represent to the art may be appreciated. There are, of course, additional features of the invention that will be described hereinafter and which will form the subject of the claims appended hereto.

BRIEF DESCRIPTION OF THE FIGURES

For detailed understanding of the present invention, references should be made to the following detailed description of the preferred embodiment, taken in conjunction with the accompanying drawings, in which like elements have been given like numerals and wherein.

DETAILED DESCRIPTION

Figure 1:
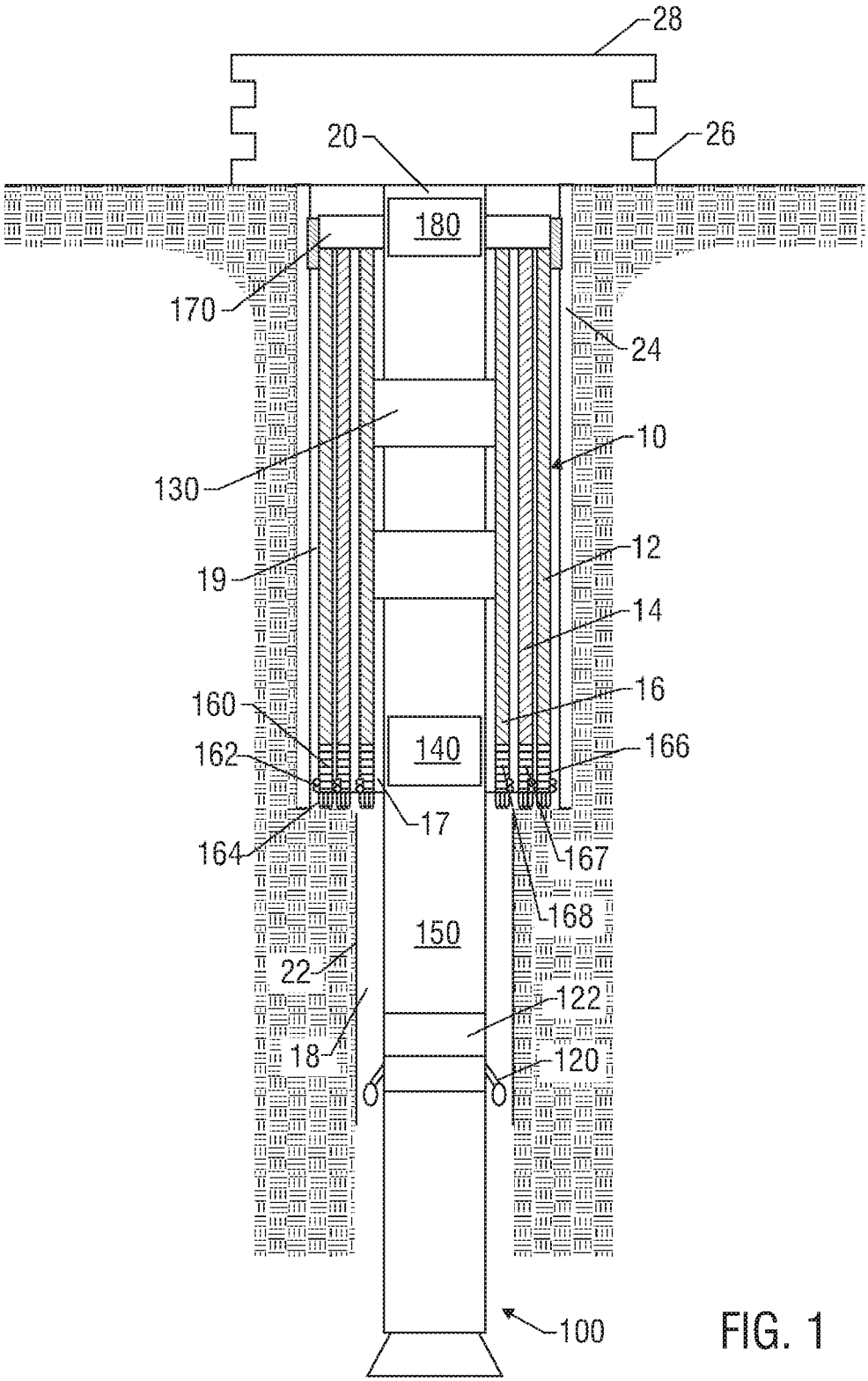
FIG. 1 schematically illustrates an elevation view of one embodiment of a nested tubular assembly made according to one embodiment of the present invention.

The present invention provides, in one aspect, systems, devices and methods for drilling and structurally supporting two or more open sections on a single trip into the well bore. The present invention is susceptible to embodiments of different forms. There are shown in the drawings, and herein will be described in detail, specific embodiments of the present invention with the understanding that the present disclosure is to be considered an exemplification of the principles of the invention, and is not intended to limit the invention to that illustrated and described herein.

Referring now to FIG. 1, there is schematically shown one embodiment of a liner or casing assembly 10 (or "tubular assembly 10") that is arranged concentrically or in a "nested" fashion. The terms "liner" and "casing" will be used interchangeably throughout to generally designate a tubular structure for providing isolation, strength, stability, and protection for a section of a wellbore. These terms are not intended to identify any particular type or class of wellbore tubulars or specify any particular dimensions, wall thicknesses, materials or other such characteristics. Moreover, while tubulars generally have a circular cross-section, other cross-sectional shapes (e.g., ovoid) may be utilized. Additionally, while liner and casings are ordinarily cemented to provide one or more of their stated functions, any method or device that connects, temporarily or permanently, these tubulars to the wellbore may be adequate for the present invention (e.g., packers external to the casing may provide adequate zonal isolation). Furthermore, while "nested" arrangements will be described herein, it should be understood that other arrangements (e.g., serially aligned) may also be suitable in certain applications. For instance, two tubulars can be axially stacked in the wellbore. After the lower tubular is connected to the wellbore, the upper tubular can pass through the lower tubular during drilling of the next section of the wellbore. In one embodiment, the pass through can be facilitated by making the lower tubular larger in diameter than the upper tubular or by expanding the lower tubular.

In the FIG. 1 embodiment, the nested tubular assembly 10 includes a plurality of concentrically disposed tubular strings 12, 14, 16 that can be conveyed into a wellbore 18 by a drill string 20 provided with a bottomhole assembly (BHA) 100. These concentric or nested tubular strings 12, 14, 16 can independently extend from one another in a telescopic fashion to thereby enter and line open hole sections, e.g., section 22, formed by the BHA 100. In one embodiment, the nested tubular string include fluid flow control mechanisms that, when actuated, selectively channel cement into an annulus between the wall of the drilled wellbore and the adjacent casing liner. Thus, two or more drilled wellbore sections can be cased and cemented with one trip of the drill string into the wellbore. In an exemplary deployment, the independently deployable multiple concentric tubular string assembly 10 is conveyed into the wellbore 18 after certain surface structure, such as surface pipe 24, a well head 26 and a blowout prevent stack (BOP) 28 have been set.

Figure 2:
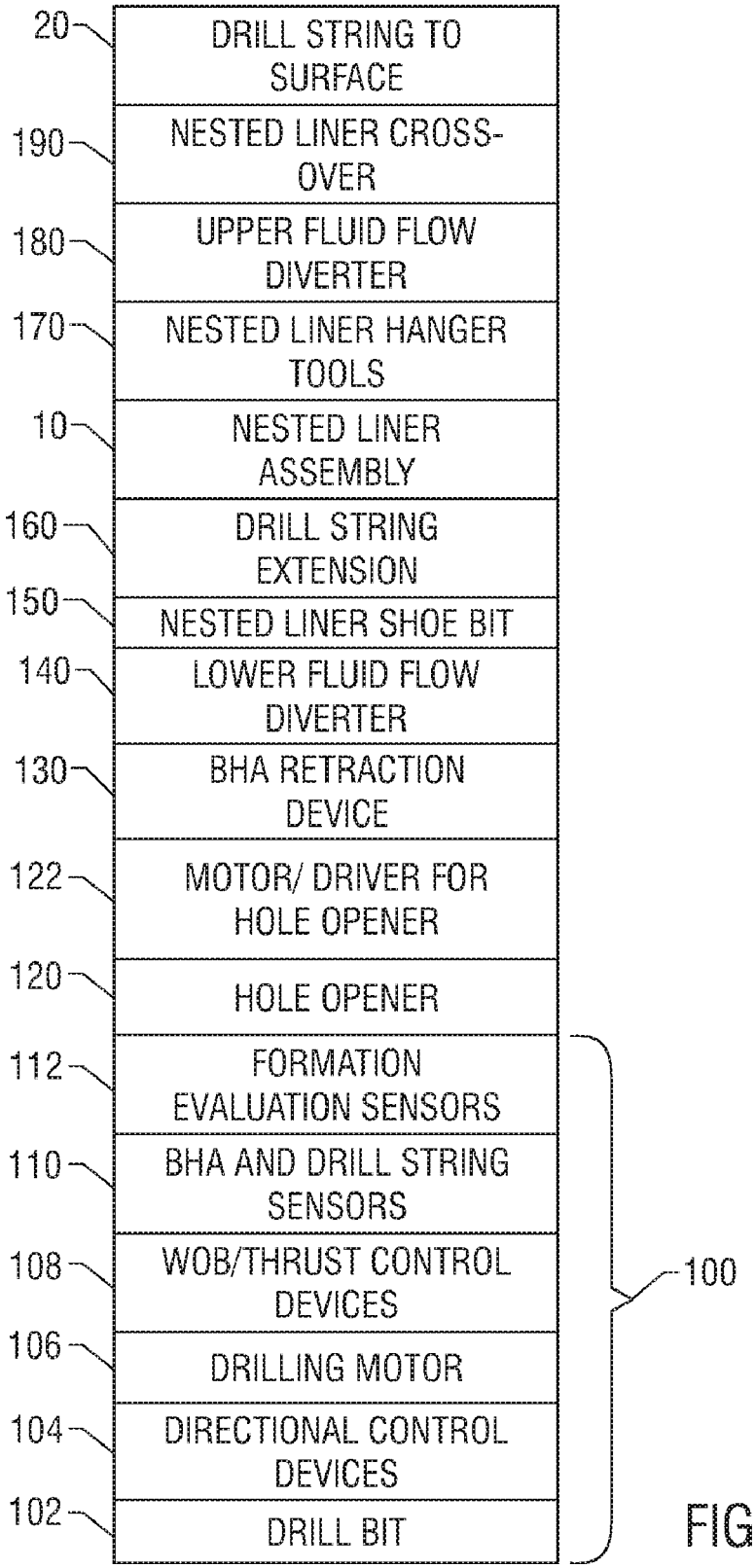
FIG. 2 schematically illustrates a functional arrangement of one embodiment of a nested tubular assembly in conjunction with a bottomhole assembly.

Referring now to FIG. 2, there is schematically shown a functional arrangement of the nested tubular assembly 10 as deployed with a BHA 100. The illustrative embodiment of FIG. 2 includes a BHA 100, a hole enlargement device 120, a BHA retraction device 130, upper and lower fluid flow diverters 140,180, a drill string extension 150, a nested liner shoe bit 160, a nested liner hanger tool 170, a nested liner cross-over 190, and a drill string 20. For brevity, the BHA 100 is not shown in pictorial form inasmuch as the teachings of the present invention are not limited to any particular design of a BHA and can apply with equal effectiveness to relatively simply top-drive systems as well as to sophisticated three-dimensional rotary steerable systems.

Advantageously, the BHA 100 can be conventional design and include features such as a steering unit and sensors for determining drilling direction, BHA performance and formation properties. Merely by way of illustration, an exemplary BHA 100 can include a drill bit 102, direction control devices 104, a drilling motor 106 for rotating the drill bit 102, and device 108 for controlling the weight on bit or the thrust force on the bit 102. The direction is controlled by controlling the direction control (steering) devices 104, which may include independently controlled stabilizers, downhole-actuated knuckle joint, bent housing, and a bit orientation device. The BHA 100 also includes sensors for (i) determining drilling assembly conditions during drilling (drilling assembly or tool parameters), (ii) determining mud motor parameters, (iii) determining the BHA's position, direction, inclination and orientation, (iv) determining the borehole condition (borehole parameters; e.g., borehole temperature and pressure), (v) determining drilling parameters, such as the weight on bit, rotational speed, and (vi) determining drill bit wear, drill bit effectiveness and the expected remaining life of the drill bit 102. Formation evaluation sensors 112 determine the nature and condition of the formation through which the borehole is being drilled. Exemplary FE tools include NMR, nuclear tools and tools for measuring gamma rays, resistivity, permeability, porosity, etc. Suitable steering units, force application members, sensors and related systems are discussed in U.S. Pat. Nos. 5,168,941; and 6,513,606, the disclosures of which are incorporated herein by reference, and which are commonly assigned to the present assignee. Suitable BHA's include those that are rotary driven and/or motor driven.

Referring now to FIGS. 1 and 2, in one embodiment, the BHA 100 extends downhole from the nested tubular assembly 10 at a length sufficient to expose the formation evaluation sensors 112 (if present) to the open section 22 of the wellbore 18. Also, the borehole size drilled by the BHA 10 is optimized for formation evaluation if such tools are utilized. Other configuration parameters and considerations will depend on the particular application. In some embodiments, the outside diameter of the BHA 100 is selected to allow at least some of the BHA 100 to be retracted into a central bore 17 of the most inner liner 16 (FIG. 1). In one mode of operation, the drill bit 102 and steering assembly 104 are motor driven and the formation evaluation tools 112 are slowly rotated by the rotation of the complete drill string 20 and nested tubular assembly 10.

To facilitate the downhole progression of the nested tubular assembly 10, one embodiment of the hole enlargement device 120 utilizes a rotary cutting action to enlarge the diameter of the wellbore 22. The hole enlargement device 120 can work in conjunction with or independently of the liner shoe bit 160 to disintegrate the formation. The hole enlargement device 120 is located uphole of the formation evaluation tools 112 and downhole of the nested linershoe bit 130. The hole enlargement device 120 can utilize cutters disposed on extensible arms or ribs that can be opened to two or more selected and controlled diameters. The cutting structure can also be formed on a collar, mandrel, or other like device. In other embodiments, the hole enlargement device can be configured to provide one diameter or a controlled range of cutting diameters. In applications where the hole enlargement device 120 may need more rotary speed than that offered by the rotation of the drill string 20, a motor 122 may be used to drive the hole enlargement device 120. The motor 122 can be, for example, a modified drill motor assembly (not shown) having an outer motor housing driving the hole enlargement device 120 and an inner shaft connected to and rotating with the primary drill string 20 and nested tubular assembly 10. In other embodiments, the drilling motor 106 can drive the hole enlargement device 120 via a suitable drive shaft or sleeve assembly (not shown). In one embodiment, the diameter provided by the hole enlargement device 120 is about twenty percent larger than the diameter of the largest unset tubular string uphole of the hole enlargement device 120 and approximately equal to the diameter of the liner shoe bit 160.

In certain applications, it may be advantageous to land the nested tubular assembly 10 at the bottom of the wellbore 18 with little or no "rat hole" or open hole section below. In embodiments where the BHA 10 extends appreciably from the nested tubular assembly 10, the BHA retraction device 100 can be used to partially or fully retract the BHA 100 into the nested tubular assembly 10. In one embodiment, the BHA retraction device 130 provides selective retraction of the BHA 100 into the inner most bore of the nested tubular assembly 10 (e.g., bore 17) and selective extension of the BHA 100 out of the nested tubular assembly 10. The BHA retraction device 130 can include cooperating latches, splines or other mechanical devices to couple and uncouple the BHA 100 from the nested tubular assembly 10. Alternatively, an explosively, pneumatically, hydraulically or electromechanically actuated assembly or anchoring tool may be utilized. During use, the BHA retraction device 130 is actuated to disengage the BHA 100 from the nested tubular assembly 10. When so disengaged, the BHA 100, which has formed an open section of the wellbore (or "pilot hole"), can be retracted into the nested tubular assembly 10. This allows the other unset liner (e.g., liner 14) of the nested tubular assembly 10 to telescope into and line the pilot hole. In some instances, the liner shoe bit and liner may have to be reamed down before the nested tubular assembly 10 is inserted into the pilot hole. After this outer tubular string has been cemented and tested, the BHA 100 is released and drilled back to an extended position. The BHA 100 can be retracted by manipulating the drill string 20 or by using a downhole device. It should be noted that the BHA retraction device 130 may not be included in some configurations, e.g., where a "rat hole" is not of concern or where the BHA 100 does not appreciably extend from the nested drilling assembly 10.

As noted earlier, embodiments of the nested tubular assembly 10 can be used to drill and line/cement a wellbore section without an intervening trip of the BHA 100 and drill string 20 to the surface. To accommodate the different fluids and different fluid flow paths associated with successive drilling and cementing steps, one embodiment of the lower fluid flow diverter assembly 140 controls the flow path of the various fluids (e.g., clean drilling mud, return mud, cement, etc.) used in the drilling and cementing process. The assembly 140 includes valve assemblies and flow conduits that control fluid communication with the nested liner shoe bit 160. In one configuration, the valve assembly controls the return fluid path so that during drilling all return mud and cuttings are routed up the inner most annular bore (e.g., annular bore 17), a small flow of the clean drill fluid is routed up an outer most annular (e.g., annular bore 19) and, during cementing, all or substantially all of the fluids are routed up the outer most annular (e.g., annular bore 19). In other embodiments, different flow control regimes may be utilized (e.g., if reverse circulation is utilized, then different flow paths may be needed).

In certain embodiments, the drill string extension 150 connects the nested liner hanger assembly 10 to the BHA 100. Much like the drill string 20, the drill string extension 150 can act as a tubular pressure tight fluid conductor and structural support element for the BHA 100. In one embodiment, the drill string extension 150 can co-act with the BHA retraction device 130 and the nested liner hanger tool 170 to retract the BHA 100 as needed (e.g., during the liner drilling down and cementing operations). Because the loadings (e.g., torsional and tension) applied to the drill string 20 and drill string extension 150 may be different, these elements may be formed of different materials and have differing dimensions and configurations. In certain other embodiments, the drill string extension 150 may be structurally similar to the drill string 20. In some embodiments, the drill string 20 can extend through the nested tubular assembly 10 and directly connect to the BHA 100 without an intervening extension piece. The term "drill string" should be construed in its broadest possible sense as any structure adapted to support wellbore operations, including members such as casing strings, liner strings, production tubing, etc.

In one embodiment, the nested liner shoe bit 160 is configured to ream and/or drill the wellbore to allow the nested tubular assembly 10 to readily progress through the wellbore 18 with the BHA 100. The nested liner shoe bit 160 can be configured as a multi-part concentric shoe having radial and longitudinally oriented cutting elements 162,164 positioned on an annular collar-like member at the downhole end of each tubular string 12,14,16 of the nested tubular assembly 10. Thus, the cutting elements 160,162 engage and cut the wellbore wall when the liner assembly 10 is rotated. The radially oriented cutting elements 162 can be configured to enlarge the wellbore in a trailing under-reamer fashion as the drill bit 102 and hole enlargement device 120 drill ahead. The longitudinally oriented drilling elements 164 engage and cut an annular face of the wellbore wall as the BHA 100 drills the wellbore 18 and also after the BHA 100 is pulled back into the inner annular at the end of each section. The liner shoe bit 160 can be configured to interface with the fluid flow control sub 140 to allow proper placement of cement and to control the flow of drilling fluids and cuttings. In some embodiments, the liner shoe bit 160 is formed as a plurality of concentric rings 166,167,168 that are configured to shear or otherwise detach from one another to allow the nested tubular assembly 10 to drill ahead after the outer most section of the nested liner has been cemented or otherwise set in place. In certain embodiments, shoe bit 160 is adapted to support and stabilize the lower end of the nested tubular assembly 10.

As described earlier, the nested tubular assembly 10 provides two or more tubular members that can be used to line a drilled wellbore. The tubular members can be arranged in a concentric and telescopic fashion wherein the lower end of the nested tubular assembly 10 is affixed to the nested liner shoe bit 160 and the upper end is connected to the nested liner hanger assembly 170. In certain embodiments, the individual liners 12,14,16 are each formed of a plurality of jointed tubulars that are made up at the surface. The individual liners 12,14,16 can be either arranged to have substantially no annular spacing between the liners 12,14,16 or sized to provide specified annular spaces that, for example, can act as fluid passages. Additionally, one or more of the liners 12,14,16 can be expandable in nature to increase the available diameter of the wellbore. Moreover, the liners 12,14,16 need not be identical in terms of length, wall thickness, or materials. Nor do the liners 12,14,16 have to be arranged in a perfectly concentric and compact fashion. Rather, in certain embodiments, one or more liners may protrude out of an adjacent liner. Further, in some embodiments, one or more of the liners 12,14,16 are formed either fully or partially out of a material, such as a non-metallic material, that does not adversely affect the performance of formation evaluation tools. It should be understood that, while three liners are shown, the liner assembly 10 can include as many individual liners as needed or practicable for a given application.

In one embodiment, the liner hanger system 170 allows selective interlocking of the tubular strings 12,14,16 making up the liner assembly 10. The liner hanger system 170 can be positioned at the uphole end of each nested liner 12,14,16 and can be configured to selectively anchor and release the individual liners 12,14,16. In one embodiment, the liner hanger assembly 170 can be configured to support, at least temporarily, the weight of the tubular strings 12,14,16 and selective release the cemented or otherwise set tubular string from the remaining liner assembly 10 so that the remaining nested tubular assembly 10 can proceed further downhole. At the next section target depth, the outer most liner hanger tool can be reset after its liner has been cemented. The innermost liner hanger can also be made expandable so that two or more sections of the nested tubular assembly become monobore in nature.

Associated with the liner hanger system 170 is the upper fluid flow diverter 180 that controls selective setting and release of the liner hanger assembly, as well as performing other functions. In one embodiment, the upper fluid flow diverter includes a valve assembly adapted to sequentially release the liners, beginning with the outer liner 12. Likewise, embodiments of the nested tubular string crossover 190 provides a mechanical bridge and fluid bypass across the nested tubular string 10 that cooperate with the liner hanger system 170, the upper fluid flow diverter 180 and other systems described above to actuate constituent components and control fluid flow. For example, the crossover 190 can include valve assemblies that channel clean drilling fluid to the BHA 100.

The drill pipe 20 supports and carries the nested liner drilling assembly 10. In some applications, the weight and inertial loadings (both axial and rotational) of the nested tubular assembly 10 can be greater than conventional drilling or liner running operations. Thus, the drill pipe 20 may be formed to have more robustness than might be used for conventional drilling operations at equal depths. In other embodiments, a wire line support cable can be used to convey the BHA, the tubular nested assembly and other equipment downhole.

Figure 3A:
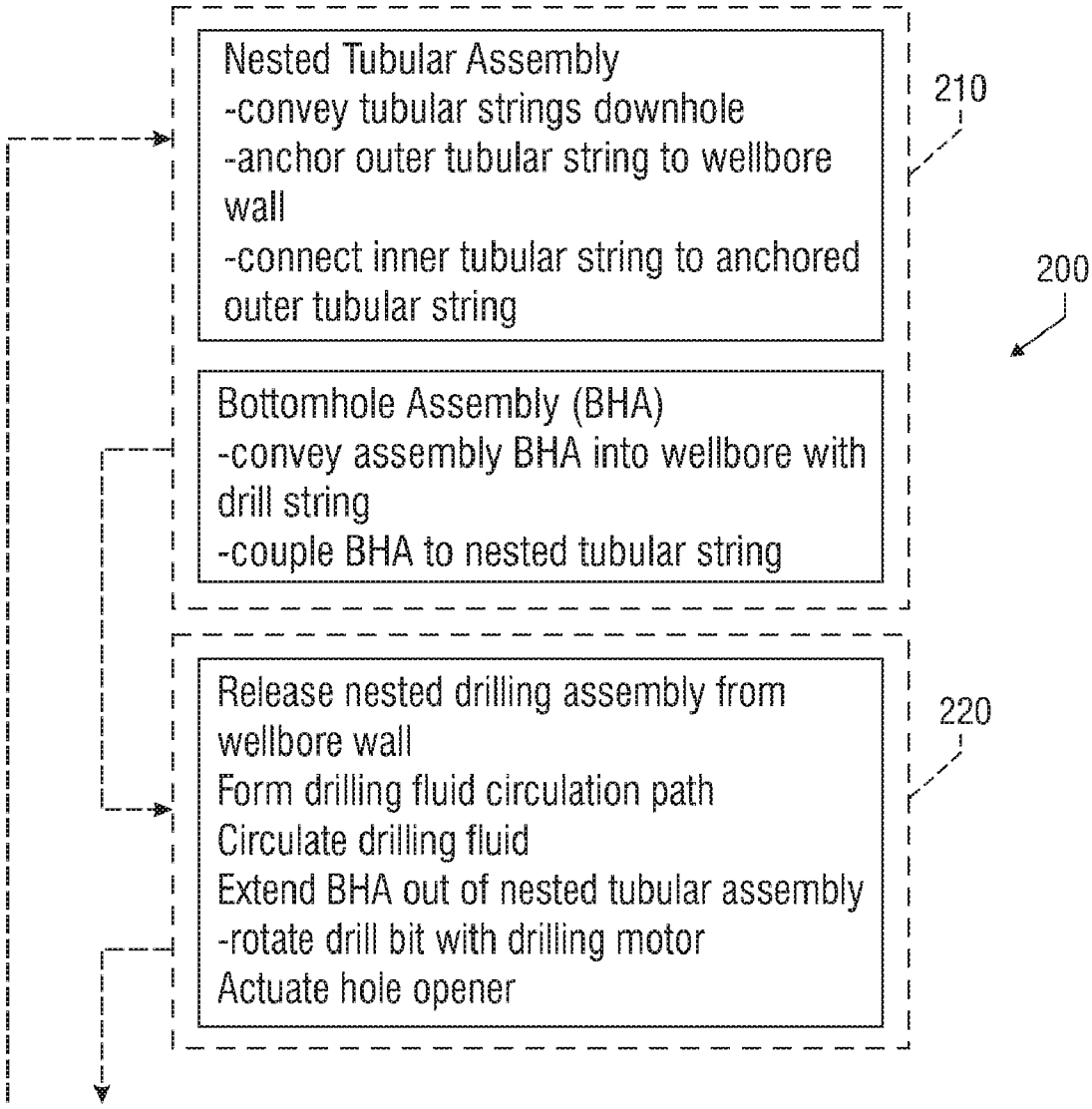
FIG. 3 illustrates a flowchart of one embodiment of a method according to the present invention.
Figure 3B:
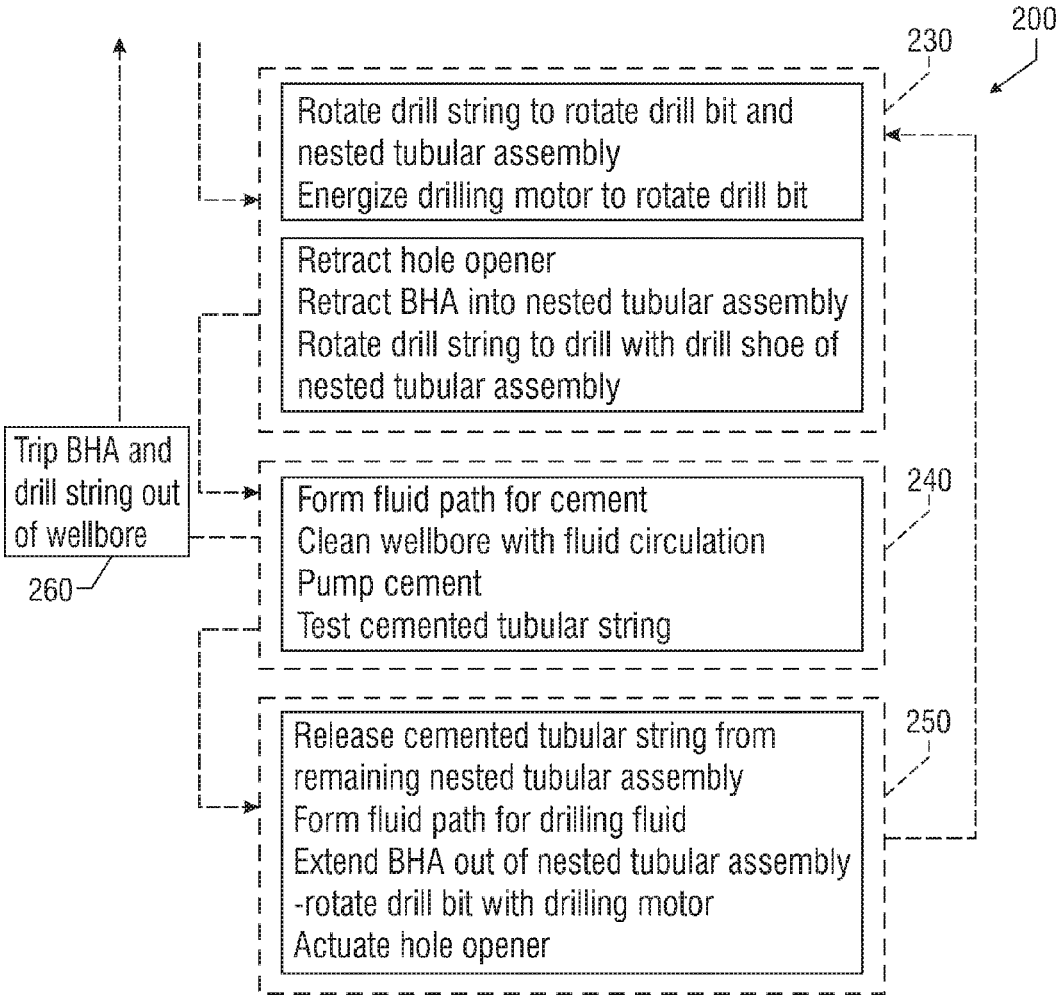

Referring now to FIG. 3, there is shown a flowchart 200 illustrating an exemplary deployment of the nested tubular assembly 10 having the steps of (i) making up the tubular assembly and BHA (step 210), (ii) configuring/setting the equipment for drilling (step 220), (iii) drilling a section of wellbore (step 230), (iii) configuring/setting the equipment for cementing and cementing (step 240), (vi) configuring/setting the equipment for drilling after cementing (step 250), and (vi) drilling another section of the wellbore (step 230). It should be appreciated that the BHA and drill string are tripped out of the hole at step 260, which is only after the completion of these described steps.

At the make-up step 210, a first tubular string and associated liner shoe bit (or "first tubular subassembly"), e.g., the most radially outer liner and associated liner shoe bit, are made up and run in the wellbore until a selected length for this first tubular subassembly is obtained. This first tubular subassembly (including the outer most liner hanger) is suspended in the wellbore from the drill rig floor with conventional casing handling tools (spiders/slips, etc.). Next, a second tubular string and associated liner shoe bit ("second tubular subassembly") are made up and run into the first (or previous) tubular subassembly using rig floor running tools until the second liner shoe bit is immediately above the first liner shoe bit. A second liner hanger assembly is made-up and run into the bore of the outer most liner until the first and second liner shoe bits latch together at which time this liner hanger is temporarily set. After the second tubular string is temporarily set with an inner hanger at the top of first tubular subassembly, the rig floor running tool is disconnected from the second tubular string to prepare for subsequent tubular subassembly make-ups, if needed, to form the nested tubular assembly 10 or allow the running of the drilling BHA into the inner most liner subassembly.

With the nested tubular assembly 10 made-up and hanging from the drill rig floor, the BHA and support equipment such as the BHA retraction device, and the lower fluid flow diverter sub, are made up and run in with the running tool and positioned within the central bore of the nested tubular assembly 10 (e.g., the BHA 100 is just uphole of the liner shoe bit assemblies). Additional support equipment such as the upper flow diverter assembly and nested tubular string crossover are then made-up and the crossover is latched into innermost tubular string. After a first joint of drill pipe is connected above the crossover, the drill pipe is lifted to lift the nested tubular assembly and BHA such that the slips connecting the nested tubular assembly to the rig floor can be released. With the nested tubular assembly now free, the assembly is lowered and suspended by slips on the drill pipe 20. At this point, the nested tubular assembly can be lifted out of the slips and run in the wellbore with drill pipe in a conventional manner. The BHA 100 and nested tubular assembly 10 are run in the wellbore until the liner shoe bit 160 and BHA 100, which is retracted within the nested tubular assembly 10, are just above the bottom of the wellbore, or still within the last tubular string.

In the configuring for drilling step 230, the BHA is released from the BHA retraction device and allowed to extend out of the nested tubular assembly until the hole enlargement device is external to the liner shoe bit. The hole enlargement device is then actuated such that the cutting elements can cut a diameter to accommodate the diameter of the outer most tubular string. Drilling fluid is then circulated to energize the drilling motor and initiate slow rotation of the drill bit. The BHA progresses into the formation and the BHA latches in fully extended position. At this point, the BHA can commence drilling.

In the drilling step 230, drilling commences with drilling fluid circulation maintained at flow rates suitable for driving downhole drill motors and the liner shoe bit being rotated by the drill string. Drilling continues until the target depth has been reached. The length of the section drilled, in some cases, is determined by the length of the tubular string to be set in the drilled section. In some configurations, the nested tubular strings will overlap to a degree at their ends in order to maintain structural continuity between the successive tubular strings. After the target depth has been reached, drilling fluid circulation may be continued or stopped while the BHA is retracted into the central bore of the nested tubular assembly. Before the BHA is retracted, the hole enlargement device is actuated to retract the drilling arms. Depending on the configuration of the hole enlargement device, the actuation may be by hydraulic, mechanical, electromechanical, electrical, pneumatic. Next, the BHA retraction device is actuated to retract BHA until BHA latches in the retracted position. At this point, drill string rotation will cause the liner shoe bit to rotate and disintegrate the formation. The nested tubular assembly drills ahead until it reaches the target depth. Circulation of drilling fluid is continued until the drilled hole is clean and in suitable condition for cementing.

In the cementing step 240, the lower and possible upper fluid flow diverter valves are first configured to form a flow path to direct cement into the annular space between the wellbore wall and the nested tubular assembly. For example, the valves are actuated to close the inner annular path used to direct return fluid uphole and open the fluid path to direct cement up the annular space. Fluids may be circulated and pipe may be manipulated to clean this annular space. After preparation of the wellbore is completed, surface pumps are activated to pump the desired volume of cement, which is followed by a washing procedure for developing extrudable plugs to ensure correct placement and cleaning of BHA. Suitable measures for holding cement behind the tubular string include holding cement pressure and/or using latch plugs. After cement is set, fluid flow diverter valves are cycled to enable actuation of the liner setting device and to set the outer most liner hanger. After the liner hanger is set, the tubular string is tested as needed for structural and hydraulic integrity. It should be understood that cement is only one suitable connecting material for connecting the tubular to the wellbore. Other connecting materials include, but are not limited to, sealants, swelling material, epoxies, resins, polymers, porous material, and non-porous material. It should also be understood that cement is only one manner of connecting the tubular string to the wellbore. Other methods include mechanical connection devices such as packers and casing external devices, whether mechanically, electrically or hydraulically actuated, that provide strength, structural integrity, and sealing can also be utilized. Indeed, in some embodiments, a mechanical, chemical, thermal or other connecting treatment of the tubular string can be utilized to connect, either permanently or temporarily, the tubular string to the wellbore.

In the preparing for drilling after cementing step 250, the upper and lower fluid flow diverter valves are cycled or reconfigured to re-establish the drilling fluid flow paths. After the fluid path downhole and uphole are established and confirmed, the BHA is released and energized to drill ahead a specified distance (e.g., a few feet). After pressure tests indicate that the just cemented shoe is adequate, drilling is continued until hole enlargement device can be opened to the selected diameter. Slow drilling continues until the BHA latches in the extended position. Next, before drilling can proceed, the just cemented tubular string is released from the adjacent inner tubular string by activating the liner hanger tool. Next, the remaining nested tubular assembly and BHA are pulled off the bottom of the wellbore and the liner shoe bits of the just cemented tubular string and adjacent tubular string are unlatched. With the nested tubular assembly and BHA now free, slow rotation is established and the BHA is slowly allowed to return to the wellbore bottom.

Drilling now proceeds in much the same manner as in step 230, i.e., with drilling fluid circulation maintained at flow rates suitable for driving downhole drill motors and the liner shoe bit being rotated by the drill string to which it is connected. Drilling continues until the target depth has been reached.

The above steps are repeated until the inner most tubular assembly has been cemented and liner hanger set and tested. Preparations are then made to pull the BHA and drill string out of the wellbore. First, the lower fluid flow diverter valve is configured or cycled to the drilling position and the upper fluid flow diverter valve is cycled to the drilling string. Next, the running tool, which anchors or connects the BHA and drill string to the cemented tubular string, is actuated to release the cemented tubular string so that the BHA can be pulled out of lower most liner. After the BHA is tripped out of the wellbore at step 260, the next nested tubular assembly (if needed) is made-up and conveyed into the wellbore.

In another embodiment, a single liner string can be run in a well bore at the same time as the drilling assembly is being run. For example, in an offshore well, after the top of the liner has passed below the well head, the liner can be temporarily hung below the wellhead. Next, the drill string is released and run to total depth drill the next section of hole. After the total depth for this drill section is reached, the drill string is pulled back into the vicinity of the hung off liner and re-latched. After latching the liner is run to bottom and cemented. The drill string is then pulled and the process can be repeated. Thus, generally speaking, a liner string is stored in the wellbore by being hung off in the wellhead or from a sub sea stack. This would eliminate the need for the liner to be attached to the drill string during the drilling operation, but enable the drilling assembly to wash and ream the liner in shortly after a section has been drilled.

The above recitation of equipment, devices, systems and steps should not be understood as a mandatory combination to practice one or more teachings of the present invention. Rather, the equipment, devices, systems and steps are merely described to illustrate desirable adaptations of the teachings of the present invention to situations that may be encountered in various applications. For instance, in certain embodiments, a BHA can be coupled to a tubular such as a casing string that has a diameter sufficient to allow the BHA to move therethrough. In such an arrangement, the BHA can be adapted to be retrieved from the wellbore via a wire line (or other suitable umbilical).

In like manner, tools and devices not described above may be utilized in certain instances to facilitate the drilling and completion activity. For example, in some applications the wellbore fluid pressure gradients may be such that the open wellbore section formed by the BHA may be susceptible to fracture or damage. One device for managing wellbore pressures and controlling the impact of equivalent circulating density (ECD) is an active differential pressure device (APD device), such as a jet pump, turbine or centrifugal pump, in fluid communication with the returning fluid. The ECD device creates a differential pressure across the device, which alters the pressure below or downhole of the device. The APD device can be driven by a positive displacement motor, a turbine, an electric motor, or a hydraulic motor. The APD device can be positioned proximate to the open hole section (e.g., uphole or adjacent the nested tubular assembly) to reduce the pressure in the open hole section. Suitable wellbore pressure management methods and devices are described in U.S. Pat. No. 6,648,081 and U.S. Pat. No. 6,415,877 and described in U.S. Applications titled "Active Controlled Bottomhole Pressure System & Method" Ser. No. 10/783,471 filed on Feb. 20, 2004 and U.S. Application titled "Subsea Wellbore Drilling System for Reducing Bottom Hole Pressure" Ser. No. 10/716,106, filed on Nov. 17, 2003, which are hereby incorporated by reference for all purposes.

In many instances, the size of the surface pipe, wellhead and BOP will determine the maximum diameter for the concentric tubular string casing assembly. Moreover, the length of the surface pipe will likely determine the maximum length of the first concentric (or nested) assembly to be run. Additional nested tubular assemblies could be run. The diameter and length of these successive nested tubular assemblies would be determined by the previous casing/liner sizes and the total depth of the well bore at the time the successive nested tubular assemblies are run. It should be understood that at least the diameter of such nested tubular assemblies is the diameter while tripping or running in the wellbore and not necessarily the set diameter (which may, for example, be larger due to expansion).

It should be understood that the terms casing and lining should be broadly construed to include any devices or mechanisms that provide one or more of wellbore stability, zonal isolation, and a formation damage/fracture protection. Furthermore, it should be understood that the term "single trip" or "reduced trip" should be construed as encompassing any procedure wherein there is not a complete trip (either into or out of the well) corresponding to each drilling step and each cement step. For example, the present invention encompasses methods and devices that utilizes one trip to line two open well sections and another trip to cement both well sections, which still provides a reduction and corresponding saving of one full trip. Still other similar permutations can also be utilized in connection with the present invention, such as a partial trip out of the well.

It should be noted that the present teaching may be applied to both offshore and land based wells. Moreover, the differences in equipment for land and offshore application can provide instances wherein modifications to the embodiments described can be advantageously applied. For instance, as is known, a riser is often used in offshore application to connect, in an umbilical fashion, a subsea wellhead to a surface facility (e.g., floating platform). In certain embodiments, a nested tubular assembly can be formed in the riser and thereafter conveyed into the wellbore.

Additionally, as noted earlier, cement is only one of several methods and devices for connecting a tubular to the wellbore. Other devices such as inflatable packers or gels can be used in some applications to connect a tubular to the wellbore. Moreover, the connection of the tubular to the wellbore need not be permanent (e.g., for the life of the well). A connection may be adequate if, for instance, it secures the tubular for a time long enough for a successive tubular to be connected to the wellbore. Thus, a wellbore can have some sections wherein inflatable packers are used to connect the tubular to the wellbore and other sections where cement is used to connect the tubular to the wellbore. One advantage of such an arrangement is that a cement column need not be formed throughout the wellbore.

In yet another aspect of the present invention, at least two casing bits of different diameter and having associated casing sections may be assembled to form a drilling assembly for drilling into subterranean formations, wherein radially adjacent casing sections are selectively releasably affixed to one another and wherein the at least two casing bits and casing sections are arranged in a telescoping relationship. Such a configuration may reduce the time needed to dispose the casing sections that are attached to each larger and smaller casing bit into the borehole.

Figure 4:
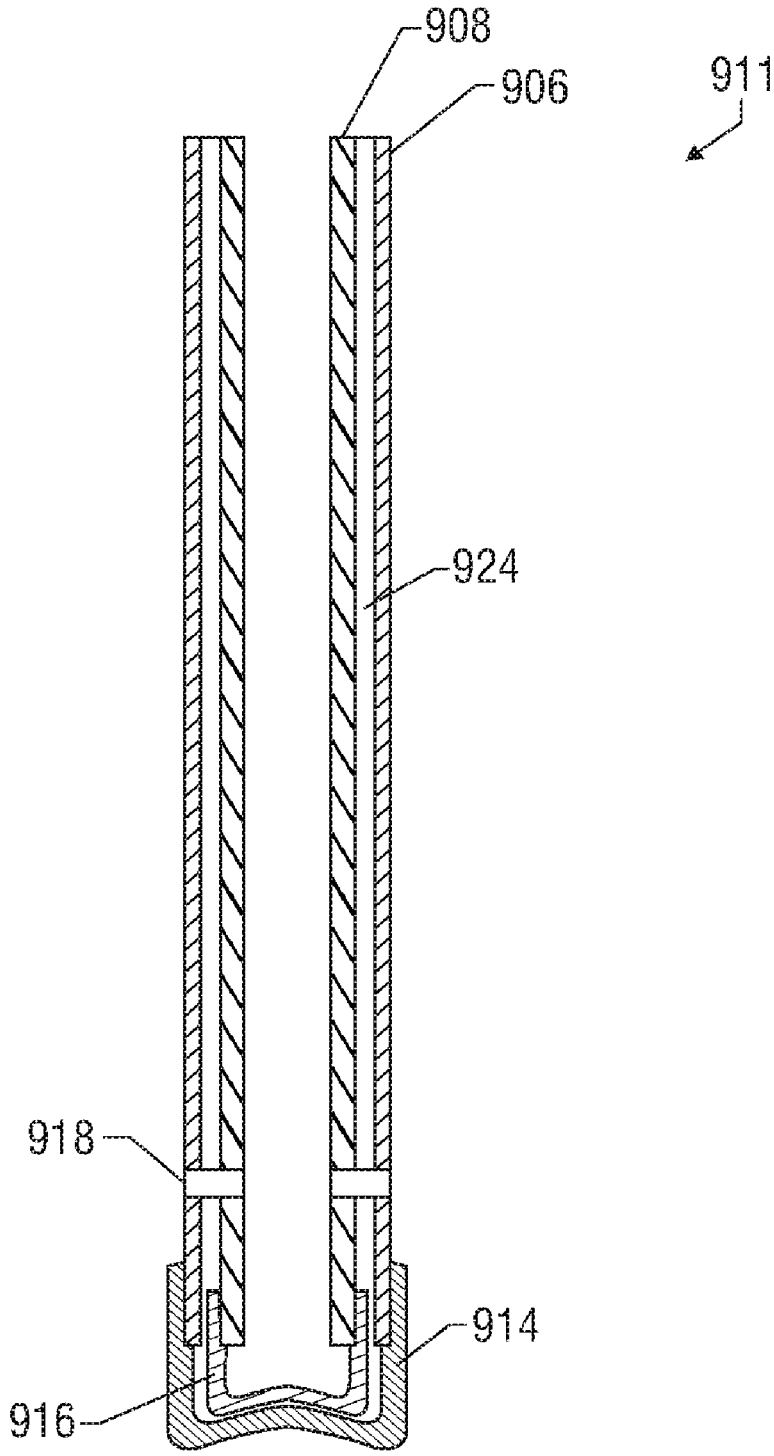
FIG. 4 shows a schematic cross-sectional view of one embodiment of a drilling assembly including three casing bits arranged in a nested telescoping relationship according to the present invention.
Figure 5:
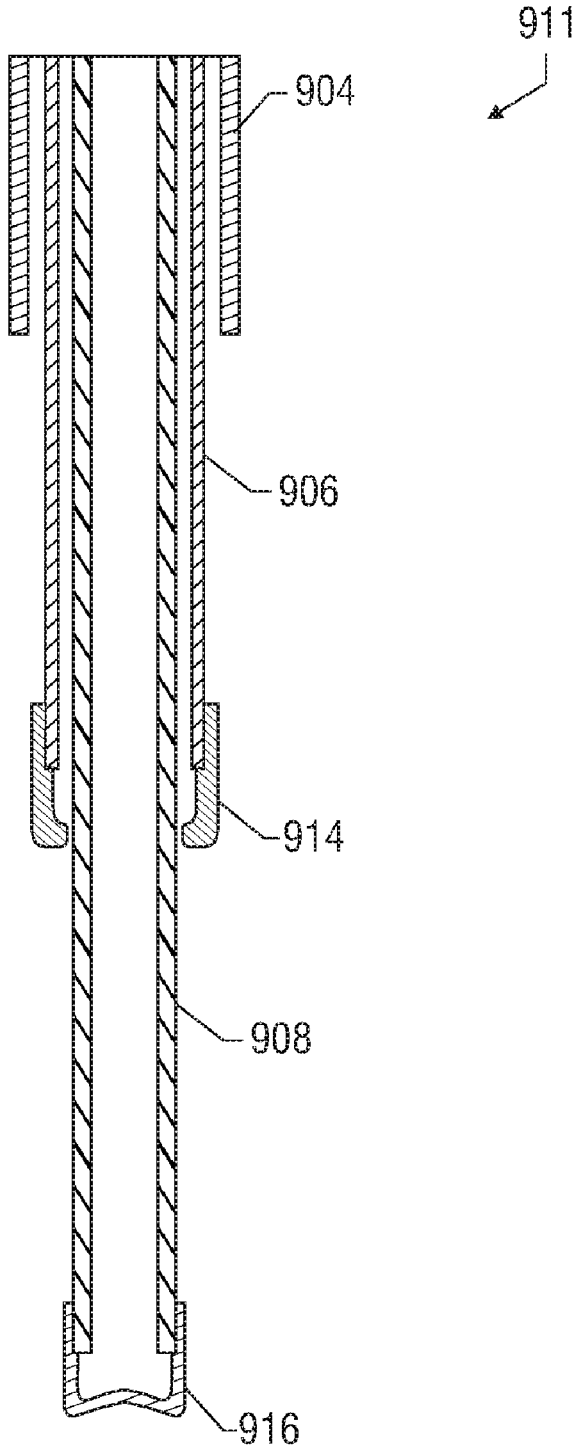
FIG. 5 shows a schematic cross-sectional view of the drilling assembly shown in FIG. 4 in an extended telescoping relationship.

For example, as shown in FIGS. 4 and 5, drilling assembly 911 may include a first casing bit 916 and a second casing bit 914, wherein the first casing bit 916 is disposed within the first casing bit 914. First casing bit 916 may be affixed to casing section 908 and second casing bit 914 may be affixed to casing section 906. Thus, the casing sections 906 and 908 may be configured in a telescoping relationship, i.e., capable of being extended from or within one another. As shown in FIG. 4, casing section 908 is affixed to casing section 906 by way of frangible elements 918. Frangible element 918 may be configured to transmit torque, axial force or weight-on-bit (WOB), or both between casing sections 906 and 908. Of course, other structures for transmitting forces between the casing sections 906 and 908 may be utilized.

Therefore, during operation, torque and WOB may be applied to casing bit 914 through casing section 906. Alternatively, torque and WOB may be applied to casing bit 914 by way of casing section 908 and through frangible elements 918. As may be appreciated, when the casing bits 914 and 916 are structurally coupled to one another, torque, WOB, or both may be transmitted therebetween. In addition, the fluid ports or apertures between each of the casing bits 914 and 916 may be coupled so that drilling fluid may be delivered through the interior of casing bit 916 to casing bit 914. Alternatively, drilling fluid may be delivered through annulus 924, while the ports or apertures of casing bit 916 may be plugged or blocked. Thus, many alternatives are possible for delivering drilling fluid or other fluids (e.g., cement) to any of casing bits 914 and 916.

As shown in FIG. 5, a casing section 904 may be disposed at a first depth. Then, casing bit 916 may be caused to drill past casing bit 914 and continue drilling to a second depth. Upon reaching a second depth, torque, WOB, or both may be applied to cause frangible elements 918 to fail or fracture. Alternatively, a frangible element may be caused to fail by way of selectively detonating a pyrotechnic agent, an explosive agent, or both. Also, the frangible element can be formulated to be selectively soluble when exposed to a chemical agent (e.g., hydrochloric acid or hydrofluoric acid), For example, a first frangible element can fail when exposed to a first chemical agent and a second frangible element, which is relatively immune to the first chemical agent, can fail when exposed to a second chemical agent. Thus, casing bit 916 may be employed to drill through casing bit 914 and to a third depth. Put another way, FIG. 5 shows drilling assembly 911 in an extended telescoping relationship. Of course, the present invention is not limited to any particular number of casing bits configured in a telescoping relationship. Rather, a drilling assembly of the present invention may include one or more casing bits disposed at least partially within one or more other casing bits in a telescoping relationship.

It should also be understood that the present invention is not limited to a smaller casing bit or casing section being positioned at least partially within another casing bit to be configured in a telescoping relationship. Rather, more specifically, a casing bit or casing section may be disposed within another casing section, which may be affixed to another, larger casing bit, to be configured in a telescoping relationship.

Figure 6:
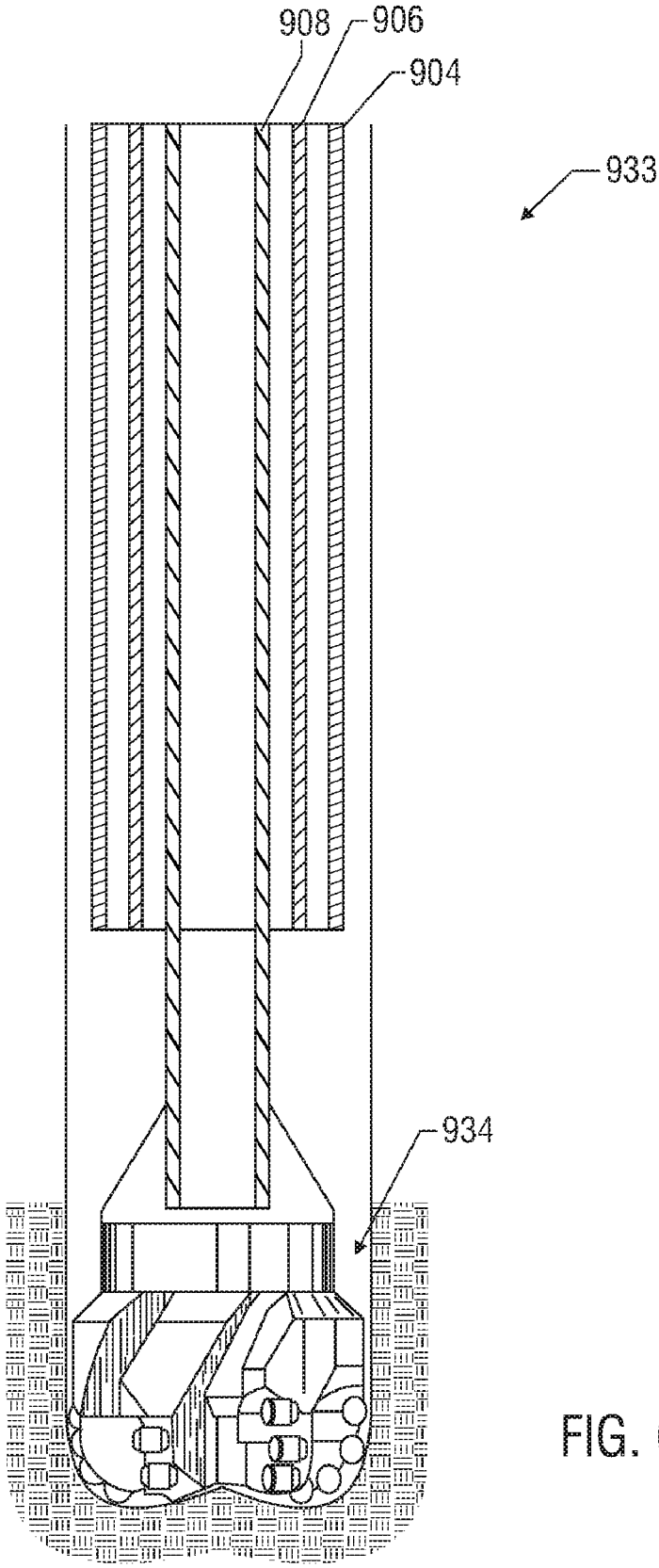
FIG. 6 shows a schematic cross-sectional view of a drilling assembly according to one embodiment of the present invention including three casing sections and a rotary drill bit.

Alternatively, an assembly of two of more casing sections configured in a telescoping relationship may be drilled into a subterranean formation by a drilling tool disposed at the leading end thereof. Specifically, as shown in FIG. 6, illustrating a drilling assembly 933, casing sections 904, 906, and 908 may be coupled together by way of, for example latching casing sections 904, 906, and 908 together to form an assembly that may be drilled into a formation by a conventional drilling tool 934 disposed at the leading end, in the direction of drilling, of the drilling assembly 933, the drilling tool 934 having a diameter that exceeds the diameter of the largest casing section 904. Drilling tool 934 may comprise a rotary drill bit, a reamer, a reaming assembly, or a casing bit, without limitation. The drilling tool 934 may precede into the formation by rotation and translation of the casing sections 904, 906, and 908. However, preferably, the drilling tool 934 may be structurally coupled to the innermost casing section 908, so that drilling tool 934 may continue to drill into the formation notwithstanding casing sections 904 or 906 becoming disposed within the borehole. Optionally, a downhole motor may be positioned between the innermost casing section 908 and the drilling tool 934.

As the drilling assembly proceeds into the formation, radially adjacent smaller casing sections may be unlatched from radially adjacent larger casing sections and extended therefrom. Of course, frangible elements (not shown) as described hereinabove (FIG. 4) may structurally connect casing sections 904, 906, and 908 to one another. Forces may be applied to fail such frangible elements, or incendiary or explosive components may be employed for failing frangible elements. Also, the frangible element can be formulated to be selectively soluble when exposed to one or more selected chemical agents. However, the telescoping relationship between the casing sections 904, 906, and 908 may provide advantage in reducing the tripping operations for disposing the casing sections 904, 906, and 908 within the borehole.

Figure 7:
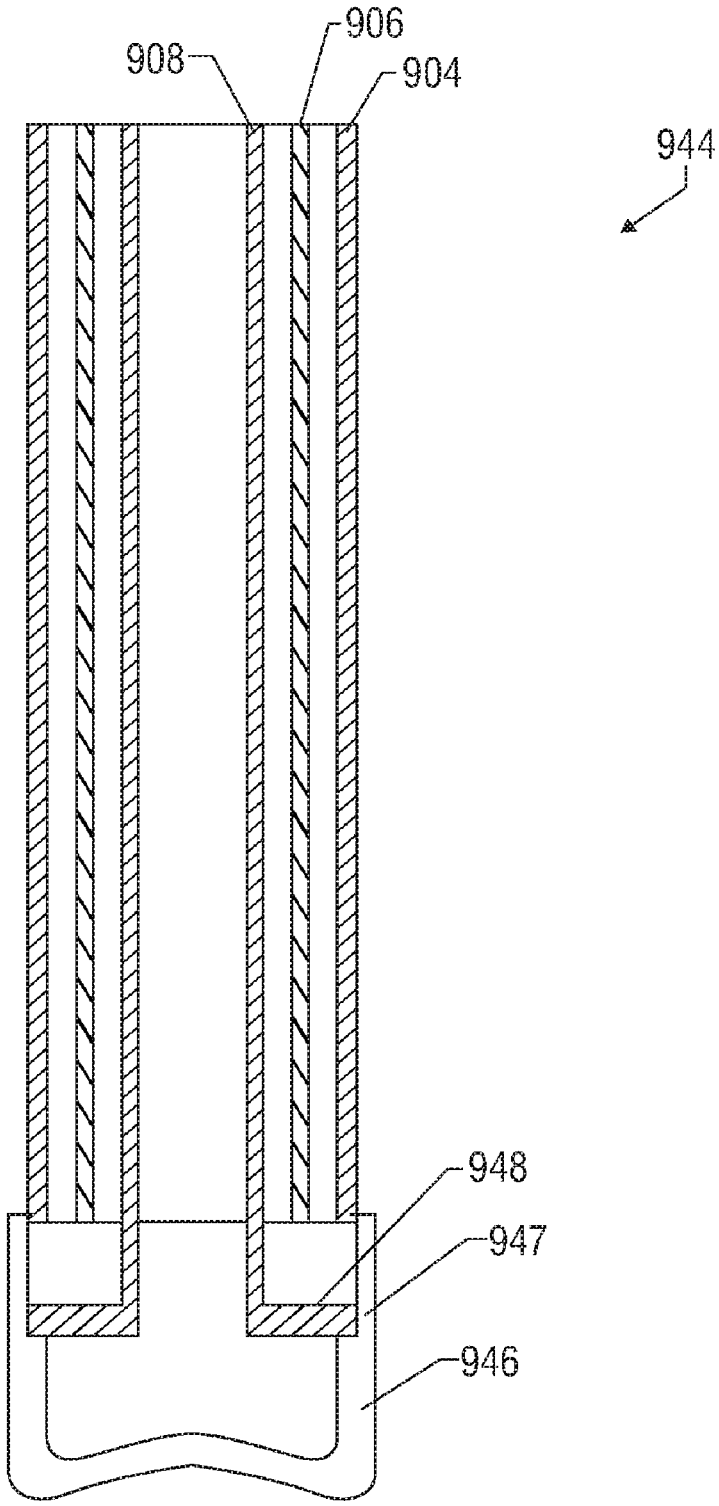
FIG. 7 shows a schematic cross-sectional view of a drilling assembly according to one embodiment of the present invention including a casing bit according to one embodiment of the present invention and three casing sections.

Additionally, an assembly of two of more casing sections configured in a telescoping relationship may be drilled into a subterranean formation by a casing bit disposed at the leading end thereof. As shown in FIG. 7, a drilling assembly 944 including casing sections 904, 906, and 908 may be drilled in to a formation by a casing bit 946 of the present invention. However, the casing bit 946 may be primarily coupled to the innermost casing section 908, as illustrated by radially extending flange 948 and attachment surface 947, so that casing bit 946 may continue to drill into the formation notwithstanding casing sections 904 or 906 becoming disposed within the borehole as well as being separated from casing section 908.

As discussed previously, formation evaluation (FE) tools typically cannot be positioned inside a casing because the metal of the casing can significantly impair the ability of the FE tools to survey the drilled formation. Accordingly, in previously described embodiments, formation evaluation tools are position in a sub in the BHA, which is below the casing string, in order to expose the FE tools to the formation. Previously described embodiments also utilized non-metallic casing sections that allow the FE tools to survey the adjacent formation through the walls of these non-metallic casing sections.

In still other embodiments, formation evaluation tools are carried on the outside of the casing string. Casing external FE tools can measure various parameters of interest relating to the formation without interference from the metal of the casing string. It should be appreciated that the length of BHA extending out of the casing string is reduced by carrying the FE tools in the casing assembly instead of the BHA. Moreover, in some embodiments, the drilling motor and/or hole enlargement device are also positioned in the casing assembly to even further reduce the length of the BHA extending below the casing assembly. Exemplary embodiments are discussed below.

Figure 8:
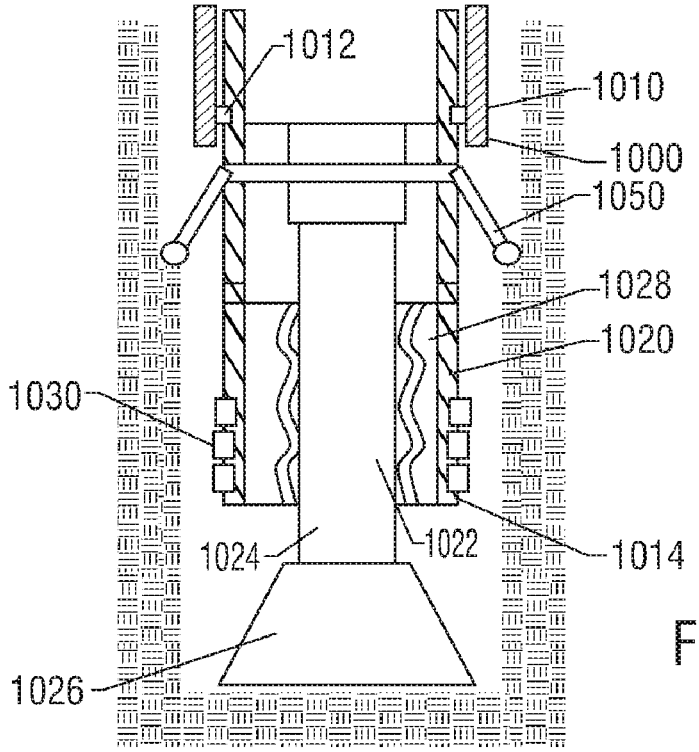
FIG. 8 shows a schematic cross-sectional view of sensors positioned on a drilling motor positioned in a tubular assembly.

Referring now to FIG. 8, there is shown a casing shoe 1000 of a casing string 1010 that is detachably connected by a latch assembly 1012 to an inner tubular string 1014 that is telescopically disposed within the casing string 1010. The inner tubular string 1014 is provided with a drilling motor 1020, formation evaluation (FE) tools 1030 mounted on the drilling motor 1020, and a hole enlargement device 1050 positioned uphole of the FE tools 1030. Connected to a rotor 1022 of the drilling motor 1020 is a shaft assembly 1024 that rotates a drill bit 1026. To rotate the hole enlargement device 1050, the casing string 1010 can be rotated or an optional motor (not shown) can be used. By positioning the FE tools 1030 on the drilling motor 1020, the length of the BHA extending below the casing shoe 1000, which is generally represented by the shaft assembly 1024 and drill bit 1026, is shortened. Additionally, as should be appreciated, additional length savings are gained by mounting or integrating the FE tools 1030 onto a housing 1028 of the drilling motor 1020 instead of using a separate sub for the FE tools 1030.

Figure 9:
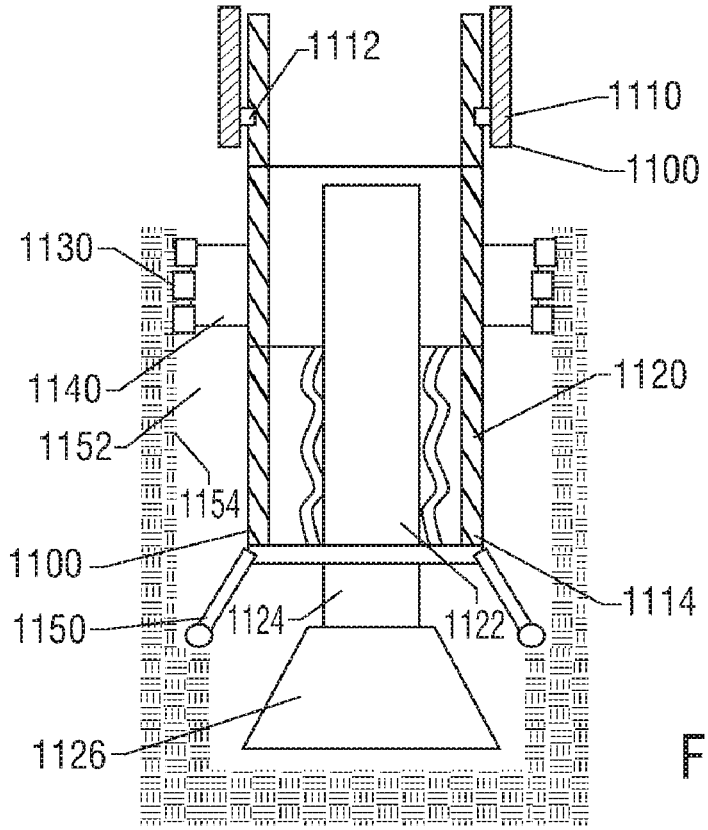
FIG. 9 shows a schematic cross-sectional view of sensors positioned on extensible arms in a tubular assembly.

Referring now to FIG. 9, there is shown a casing shoe 1100 of a casing string 1110 that is detachably connected by a latch assembly 1112 to an inner tubular string 1114 that is telescopically disposed within the casing string 1110. The inner tubular string 1114 is provided with a drilling motor 1120, FE tools 1130 mounted on extensible members 1140, and a hole enlargement device 1150 positioned downhole of the FE tools 1130. The casing string 1110 can be rotated or an optional motor (not shown) can be used to rotate the hole enlargement device 1150. Connected to a rotor 1122 of the drilling motor 1120 is a shaft assembly 1124 that rotates a drill bit 1126. Because the FE tools 1130 are mounted uphole of the hole enlargement device 1150, an annular space 1152 can separate the casing string 1110 from the wellbore wall 1154. Because many formation evaluation sensors operate optimally when positioned close to the wellbore wall 1154, the extensible members 1140 are used to move the FE tools 1130 radially outward to the wellbore wall 1150. The members 1140 can be pads or arms can be moved using biasing members such as springs, hydraulic power, or electromechanical devices such as an electric motor.

Figure 10:
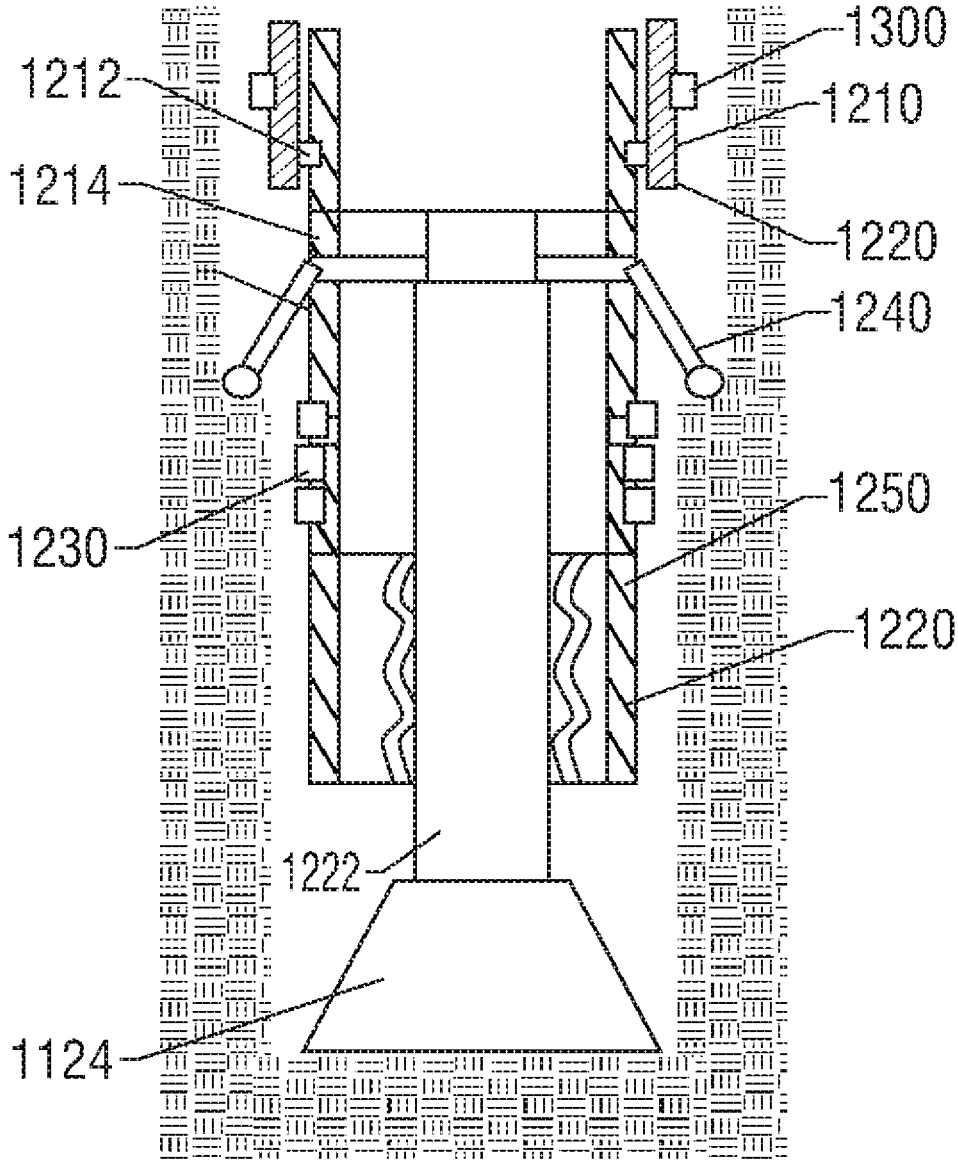
FIG. 10 shows a schematic cross-sectional view of sensors disposed in a section of a tubular assembly adjacent a drilling motor positioned in a tubular assembly.

Referring now to FIG. 10, there is shown a casing shoe 1200 of a casing string 1210 that is detachably connected by a latch assembly 1212 to an inner tubular string 1214 that is telescopically disposed within the casing string 1210. The inner tubular string 1214 is provided with a drilling motor 1220, FE tools 1230 mounted uphole of the drilling motor 1220, and a hole enlargement device 1240 positioned uphole of the FE tools 1230. The casing string 1210 can be rotated or an optional motor (not shown) can be used to rotate the hole enlargement device 1240. Unlike the FIG. 8 embodiment, the FE tools 1230 are positioned in a sub 1250 separate from the drilling motor 1220.

While the FE tools, such as FE tools 1230, are shown as positioned on an inner string of the telescoping tubular assembly, it should be appreciated that each tubular making up a telescoping tubular assembly can include a set of FE tools. For example, in FIG. 10, a second FE tool 1300 can be positioned on the casing string 1210 in addition to the FE tools 1230 on the inner string 1214.

It should be understood however that the teachings of the present invention are not limited to formation evaluation sensors and tools. FE tools are merely exemplary of the tools, devices and equipment that are conventionally positioned in a BHA and can in certain instances contribute to the overall length of a BHA. In other embodiments, device positioned on the casing include tools and sensors that are utilized for adaptive control downhole and for forming a closed loop drilling system. Adaptive control could include a releasing mechanism for the outermost casing, flow isolation, vibration damping, etc. In addition to sensors, devices such as actuators can be positioned on or in a casing body. These actuators, in conjunction with the sensors, can be used to activate devices such as an expandable reamer built on the outermost casing once the casing is on bottom.

It should be understood that the FE tools 1030, 1130, 1230 are described as "on," "external" or "outside" of the casing string in only the functional sense. That is, the FE tools need not be physically outside of the casing string. Rather, the FE tools can be embedded partially or fully embedded in a non-metallic section of a casing string (e.g., a section made of carbon fiber) or in a manner that allows the FE tools to "look outside" the casing string. Furthermore, it should be understood that sensors other than FE tools can be utilized in accordance with the present teachings. For example, casing mounted sensors can be pointed inward to measure parameters of interest relating to wellbore fluids, drilling fluids, produced formation fluids or other objects of interest. Other suitable sensors can include pressure transducers, seismic sensors, temperature sensors and other known devices that measure parameters of interest during drilling and after drilling, e.g. during completion activity such as cementing and during production.

Power and data transfer between the casing external sensors and downhole and/or surface processors and power supplies can be established using suitable power and data buses (not shown). Devices such as inductive couplings and electrical slip rings can be used to transfer power/data across rotating interfaces. Additionally, telemetry arrangements utilizing hard wires through tubulars, fiber optic cables, electrical cables, mud pulse telemetry, acoustics, short-hop, radio telemetry, electromagnetics, etc. can be used to transmit data along the BHA and casing string and to and from the surface.

While the foregoing disclosure is directed to the preferred embodiments of the invention, various modifications will be apparent to those skilled in the art. It is intended that all variations within the scope of the appended claims be embraced by the foregoing disclosure.

What is claimed is:

1. A method of drilling a wellbore in a subterranean formation, comprising:

attaching a liner shoe bit to a first tubular and a second tubular;

conveying the first tubular and the second tubular into the wellbore;

running a drilling tool into one of the first tubular and the second tubular;

drilling a first pilot hole with the drilling tool;

enlarging the first pilot hole by rotating the attached liner shoe bit while running the first tubular into the enlarged first pilot hole;

connecting the first tubular to the wellbore without tripping the drilling tool out of the wellbore;

drilling a second pilot hole with the drilling tool; and enlarging the second pilot hole by rotating the attached liner shoe bit while running the second tubular into the enlarged second pilot hole.

2. The method according to claim 1 further comprising tripping the drilling tool out of the wellbore after the connecting step.

3. The method according to claim 1 wherein one of the first tubular and the second tubular is connected to the wellbore using one of (i) a connecting material, (ii) a mechanical connection device, and (iii) a connecting treatment.

4. The method according to claim 1 further comprising connecting the second tubular to the wellbore.

5. The method according to claim 1 further comprising assembling the first tubular and the second tubular in the wellbore to form a telescopic tubular assembly.

6. The method according to claim 1 further comprising retracting the drilling tool into one of the first tubular and the second tubular.

7. The method according to claim 1 further comprising positioning at least one tool at least partially on one of the first tubular and the second tubular to determine at least one parameter of interest.

8. The method according to claim 7 wherein the at least one tool measures a parameter relating to one of (i) a formation, and (ii) a wellbore fluid.

9. The method according to claim 7 wherein the at least one tool includes a first tool pointed substantially outward to measure a parameter of interest relating to the formation and a second tool pointed substantially inward to measure a parameter of interest relating to a wellbore fluid.

10. A method of drilling a wellbore in a subterranean formation, comprising:

attaching a first tubular to a second tubular with a liner hanger assembly;

conveying the first tubular and the second tubular into the wellbore;

drilling a first open hole section with a drilling tool while running the first tubular into the first open hole section;

drilling a second open hole section with the drilling tool while running the second tubular into the second open hole section; and cementing at least one of the first tubular and the second tubular to the wellbore without tripping the drilling tool out of the wellbore.

11. A method of drilling a wellbore in a subterranean formation, comprising:

conveying a first tubular and a second tubular into the wellbore;

drilling a first open hole section with a drilling tool while running the first tubular into the first open hole section;

drilling a second open hole section with the drilling tool while running the second tubular into the second open hole section;

cementing at least one of the first tubular and the second tubular to the wellbore without tripping the drilling tool out of the wellbore;

positioning at least one tool at least partially on one of the first tubular and the second tubular to determine at least one parameter of interest, wherein a hole enlargement device is positioned downhole of the at least one tool; and tripping the drilling tool out of the wellbore after connecting the first tubular and the second tubular to the wellbore.

12. A method of drilling a wellbore in a subterranean formation, comprising:

conveying a first tubular and a second tubular into the wellbore;

drilling a first open hole section with a drilling tool while running the first tubular into the first open hole section;

drilling a second open hole section with the drilling tool while running the second tubular into the second open hole section;

connecting at least one of the first tubular and the second tubular to the wellbore without tripping the drilling tool out of the wellbore;

positioning at least one tool at least partially on one of the first tubular and the second tubular to determine at least one parameter of interest, wherein a hole enlargement device is positioned on the tubular member and uphole of the at least one tool.

* * * * *